US005700385A

United States Patent [19]

Jones

[11] Patent Number: 5,700,385

[45] Date of Patent: Dec. 23, 1997

[54] APPARATUS FOR SUPPORTING AND LOCATING BURIED CABLE AND SIMILAR DEVICES

[76] Inventor: Thaddeus M. Jones, 1302 High St., South Bend, Ind. 46601

[21] Appl. No.: 582,927

[22] Filed: Jan. 4, 1996

[51] Int. Cl.[6] ..... E04C 5/18; E01C 23/04

[52] U.S. Cl. ..... 249/91; 52/677; 52/689; 404/71; 404/136

[58] Field of Search ..... 249/91; 404/71, 404/100, 136; 52/677, 689

[56] References Cited

U.S. PATENT DOCUMENTS

| | | | |
|---|---|---|---|
| 1,349,136 | 8/1920 | Lillard | 404/71 |
| 1,771,268 | 7/1930 | Musgrave | 404/71 |
| 2,291,157 | 7/1942 | Hillberg | 404/136 |
| 2,783,695 | 3/1957 | De Canio | 404/136 |
| 3,104,600 | 9/1963 | White | 404/136 |
| 3,173,187 | 3/1965 | Pontiere | 249/91 |
| 3,439,732 | 4/1969 | Andreoli | 249/91 |
| 4,244,681 | 1/1981 | Comerford et al. | 249/91 |
| 4,493,584 | 1/1985 | Guntert | 404/100 |
| 4,653,718 | 3/1987 | Dickens | 249/91 |
| 4,689,867 | 9/1987 | Tolliver | 249/91 |

*Primary Examiner*—James P. Mackey
*Attorney, Agent, or Firm*—R. Tracy Crump

[57] ABSTRACT

An apparatus or clip is disclosed, which can be used both to securely hold and support a heating cable or mat at a desired depth within a slab form, and to easily locate the cable or mats once embedded using a simple magnetic field. The clips of this invention are constructed from a material that has a suitable magnetic susceptibility for permitting detection by a weak magnetic field. Consequently, the clip can be located using a simple bar magnet or a common stud finder. The high magnetic permeability of the clip compared to the surrounding earth, asphalt or concrete allows the clip to be readily located by a stud finder. As a stud finder is passed over the clip, the magnetic needle is attracted to the clip apparatus by the emitted magnetic flux. The configuration of the clip includes two upright legs and two horizontal feet. The legs are bent to support and space the mat or cable above the feet. The length of the legs is sufficient to position the apex of the apparatus adjacent the upper surface of the ground, concrete or asphalt. The legs are bent into a configuration for supporting the mat or cable at a height above the horizontal feet, which ensures positioning of the mat or cable at a uniform depth.

1 Claim, 5 Drawing Sheets

APPARATUS FOR SUPPORTING AND LOCATING BURIED CABLE AND SIMILAR DEVICES

This invention relates to an apparatus used to hold and support buried cables and similar devices at set depths, and has particular relevance to an apparatus that is used to hold and support embedded electrical heating cables and mats at set depths within asphalt and concrete slabs, which allows the embedded cables and mats to be readily located by the magnetic field of a common stud finder.

BACKGROUND OF THE INVENTION

Electrical snow and ice removal systems are commonly used to prevent the accumulation of snow and ice on exposed concrete and asphalt surfaces, such as sidewalks, walkways, handicap ramps, and parking lots. Electrical snow and ice removal systems use embedded heating cable and heating mats to internally heat the slab, thereby preventing the accumulation of snow and ice on the exposed surface. The proper field installation and physical location of the heating cables and mats is critical to the operation and efficiency of electrical snow and ice removal systems.

Heating cable and mats must be embedded at uniform depths within the asphalt and concrete slabs to ensure that the slab is uniformly heated. When cables and mats are embedded too deep or too shallow, cold spots or hot spots are created across the surface of the slab, which greatly reduce the effectiveness and efficiency of the heating system. During field installation, the heating cable and mats are laid within the forms, which define the slab, before the asphalt or cement is poured. The problems with embedded cable and mats at uniform depths are complicated by the manner in which the heating cable and mats are provided to the installers. Generally, heating cable is supplied on spools. When unspooled, the heating cable does not lay straight and flat in the slab forms, but curls and coils. Likewise, the flat plastic sheets of heating mats are provided in rolls. When unrolled, the corners and edges of the mats curl. Consequently, the heating cable and mats must be tacked down at a set depth within the slab forms to prevent ends, edges and corners from curling.

Frequently, heating cables and mats are mispositioned, severed and damaged before or during the pouring of the slabs. Heating cable and mats can be damaged by careless or improper installation. Careless worker have severed heating cable and mats with shovels while pouring and working the cement. Frequently, cables and mats are installed so that they cross the expansion joints cut in the slabs. As a result, heating cables and mats can be severed when the slab cracks along the expansion joints from thermal expansion.

Once embedded, locating a damaged or severed cable or mat within the slab is difficult. Heretofore, locating the ends of a single heating cable or the corners of an individual heating mat has been a matter or guess work. Because the ends of a heating cable and the corners of a heating mat are not readily locatable, large sections of concrete must be broken up and repoured in order to replace damaged heating cable or mats. If the end of the heating cable or the corners of the damaged heating mat could be precisely located, only that area of the slab effected would need be removed in order to replace the damaged cable or mat.

An apparatus that can be used both to securely hold a heating cable or mat at the desired depth within the slab forms and to easily locate the cable or mat once embedded would greatly reduce the problems associated with the installation and replacement of embedded heating cable and mats in electrical snow and ice removal systems. Such an apparatus could also be utilized in a variety of other related fields, where buried or embedded devices must be located. For example, utility companies are often required to locate buried utility lines. Often, locating buried utility lines, particularly utility lines which use non-magnetic and fiber optic cable, involves guess work or expensive complicated instrumentation. A variety of sensitive line detection devices have been developed using electromagnetic fields to locate buried lines; however, these devices are not effective for locating buried fiber optic cables. Only visible external markers can be used to mark the location of certain buried utility lines. Visible external markers are often lost, destroyed or eroded over time. Consequently, an apparatus which can eliminate the time lost in the trial and error of locating buried utility lines would be greatly advantageous.

SUMMARY OF THE INVENTION

The apparatus or clip of this invention can be used both to securely hold and support a heating cable or mat at a desired depth within a slab form, and to easily locate the cable or mats once embedded using the simple magnetic field of a bar magnet. The apparatus can also be used to support and located other buried or embedded devices, such as buried utility cables. In use, a plurality of clips are attached to elevate the heating cable or mats to a desired uniform depth. A clip is attached at the ends of each heating cable and at each corner of a heating mat, so that they are readily located.

The clips of this invention are constructed from a material that has a suitable magnetic susceptibility for permitting detection by a weak magnetic field. Consequently, the clip can be located using a simple bar magnet or a common stud finder. The high magnetic permeability of the clip compared to the surrounding earth, asphalt or concrete allows the clip to be readily locate by a stud finder. As a stud finder is passed over the clip, the magnetic needle is attracted to the clip apparatus by the emitted magnetic flux. The high magnetic permeability also allows the clip to be detected and precisely located using other metal or treasure finding devices. Preferably, the material from which the clips are formed is a non-corrosive metal alloy, which can be bent, forged or cast into suitable configurations.

Three different embodiments of the clip of this invention are described herein. In each embodiment, the configuration of the clip includes two upright legs and two horizontal feet. The clip stands erect on its feet, so that the clips elevate the heating cable or mats to a desired depth. In one embodiment the legs are bent so that a heating mat can be supported on a horizontal shoulder segment. In a second embodiment, a heating cable is restrictively held between the bent legs of the clip. The length of the legs position the top of the clip just below the surface of the concrete or ground, so that the clip can easily detected by the magnetic field of a stud finder.

Accordingly, an advantage of the clips of this invention is that they securely support and affix a heating cable or mat at a desired depth within a slab form or trench.

Another advantage of the clips of this invention is that they can be located using the magnetic field of a common bar magnet or a common stud finder.

Other advantages will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiments herein described are not intended to be exhaustive or to limit the invention to the precise form disclosed. They are chosen and described to best explain the invention so that others skilled in the art might utilize its teachings.

Three embodiments of the apparatus or clips of this invention are described herein. In each embodiment, the clip is constructed from a material that has a suitable magnetic susceptibility for permitting detection by a weak magnetic field. Consequently, the clip of this invention can be located using a simple bar magnet or a common stud finder. Generally, any non-corrosive material which has a magnetic susceptibility greater than one can be used. The high magnetic permeability of the clip compared to the surrounding earth, asphalt or concrete allows the clip to be readily located by a stud finder. The high magnetic permeability also allows the clip to be detected and precisely locate using other metal or treasure finding devices. Preferably, the material from which the clip is formed is a non-corrosive magnetic alloy, which can be bent, forged or cast into a suitable configuration.

Figure 2:
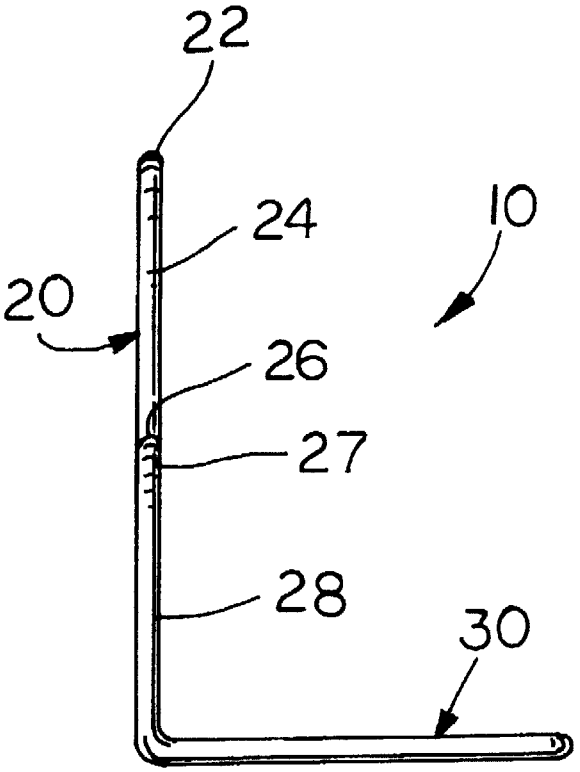
FIG. 2 is a side view of the clip of FIG. 1.
Figure 1:
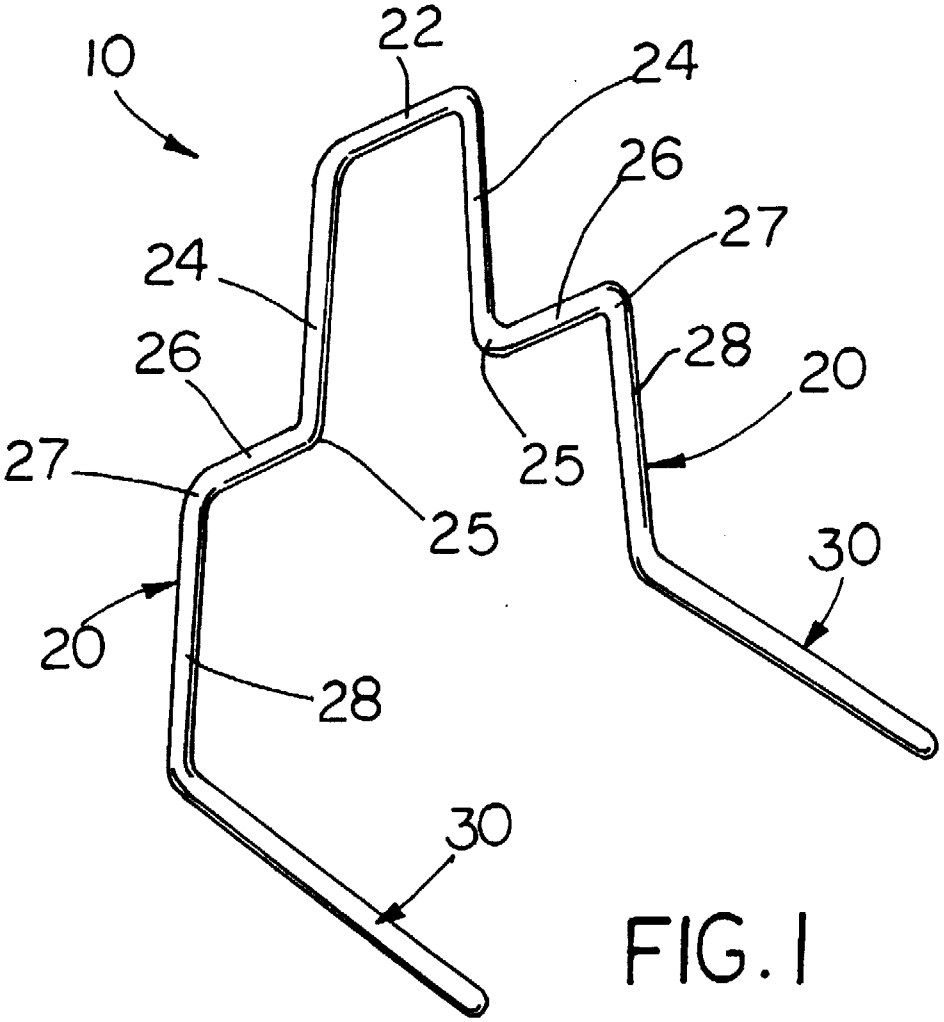
FIG. 1 is a perspective of one embodiment of the clips of this invention.

FIGS. 1–4 show one embodiment of the clip of this invention for use with a typical electrical heating mat, such as the ones manufactured by EasyHeat, Inc. of New Carlisle, Indiana. Clip 10 is formed from a length of non-corrosive magnetic alloy wire, which is bent into the configuration shown. The configuration of clip 10 includes two upright Z-shaped legs 20, a horizontal upper cross member 22 and two horizontal feet 30. Legs 20 and cross member 22 lie in a substantially upright plane as shown in FIG. 2. Each leg 20 has two bends 25, 27 which form an intermediate horizontal segment 26 between two upright segments 24, 28. Foot 30 extends horizontally normal to the upright plane of legs 20 and allows clip 10 to stand erect.

Figure 3:
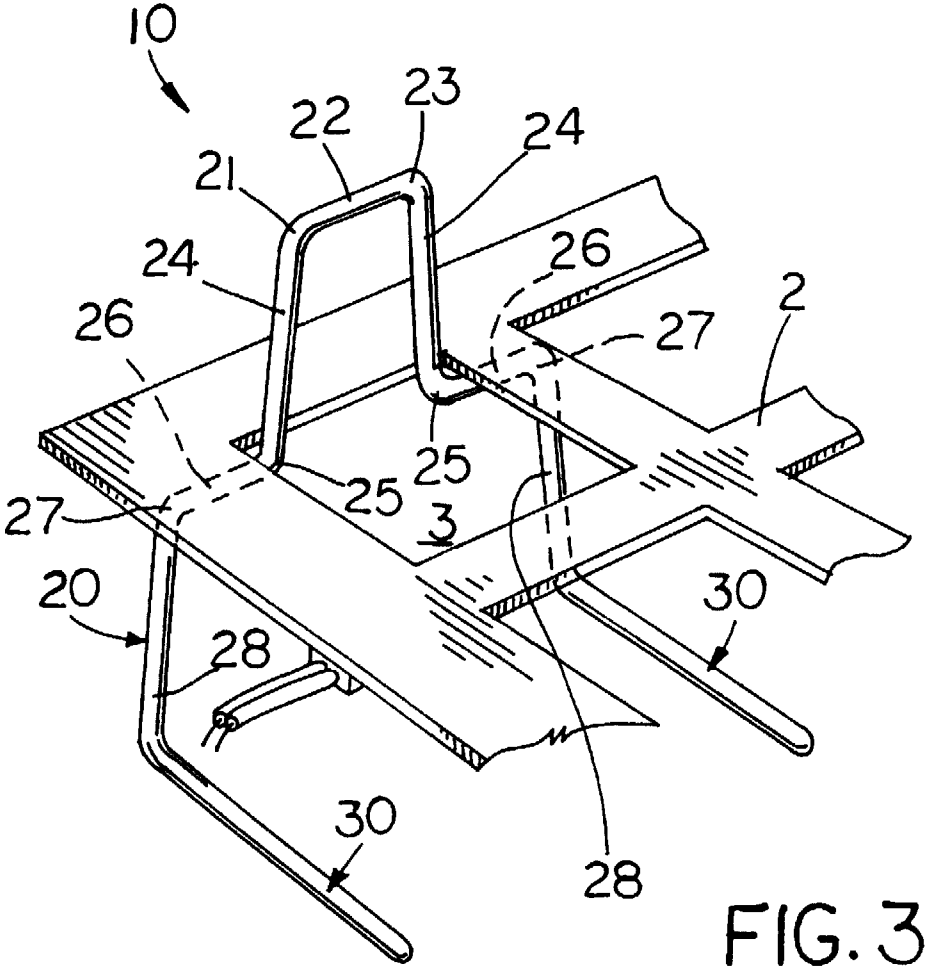
FIG. 3 is a perspective view of the clip of FIG. 1 and a conventional electrical heating mat.
Figure 4:
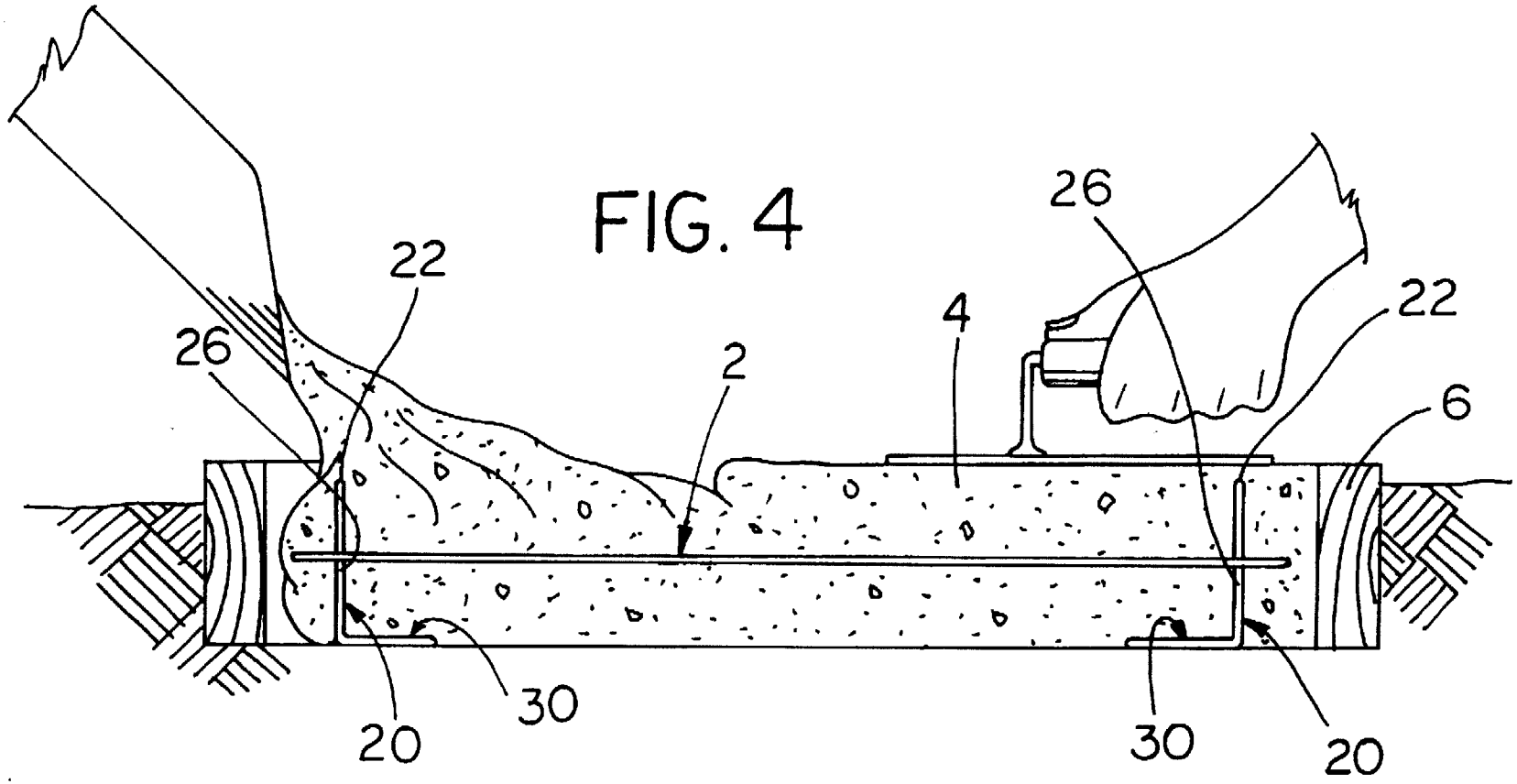
FIG. 4 is a side view of the clip of FIG. 1 supporting an electrical heating mat in a slab form as cement is poured into the form.

As shown in FIGS. 3 and 4, horizontal segment 26 of leg 20 provides a shoulder or platform on which a conventional electrical heating mat 2 is supported. Upper segment 24 of the legs extends through the opening 3 of heating mat 2 and the edge of the mat rests atop of horizontal segments 26. Horizontal segment 26 supports mat 2 at the proper depth within slab form 6. Clips 10 are placed in each corner of mat 2, with multiple clips supporting the center of the mat as needed to elevate the mat to the desired uniform depth within slab form 6.

Figure 5:
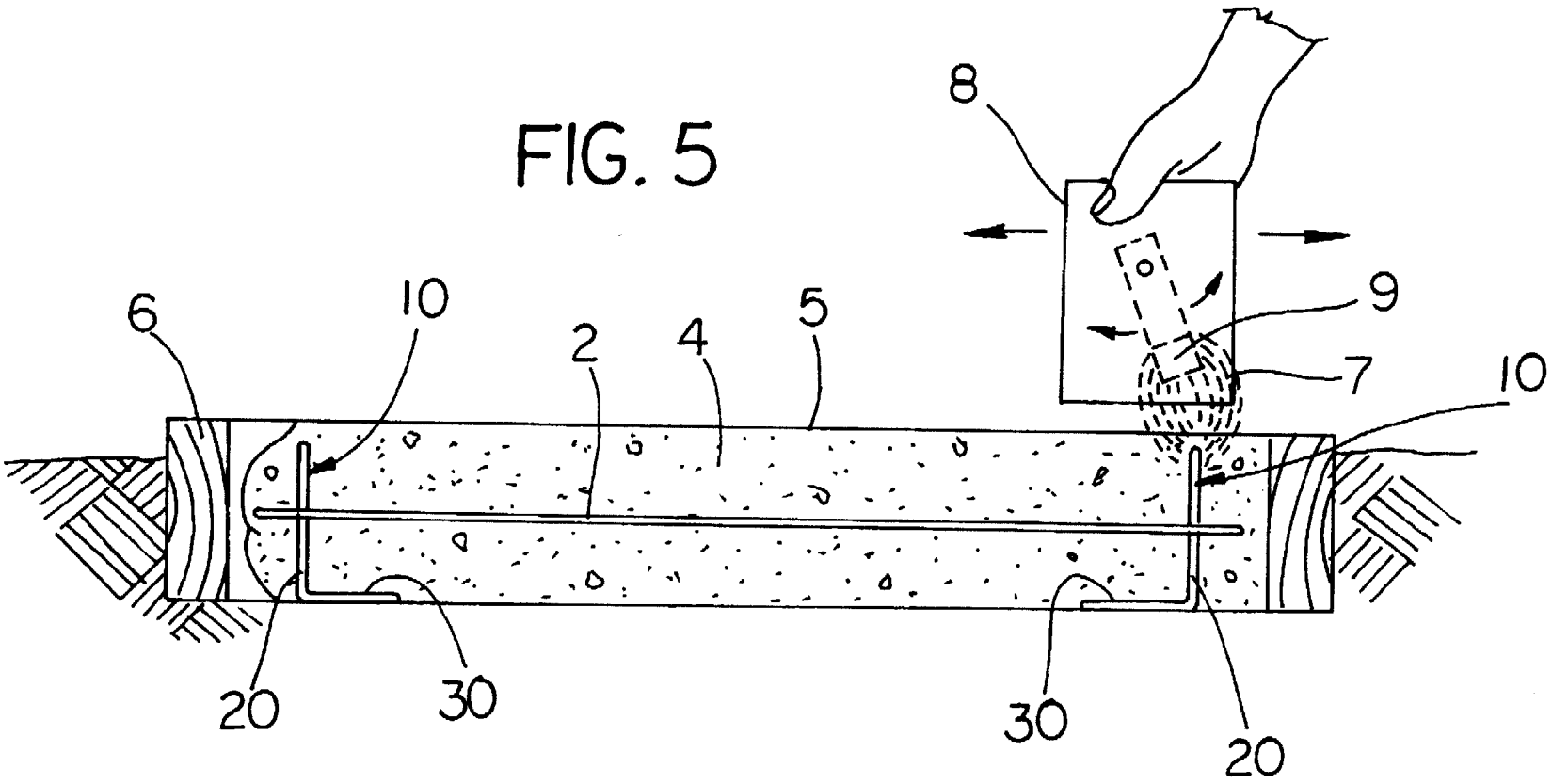
FIG. 5 is a side view of the clip and the electrical heating mat embedded within a concrete slab and a stud finder locating the clip.

As shown in FIG. 5, clip 10 stands erect on feet 30 and the length of legs 20 is sufficient to position cross segment 21 just below the surface 5 of the concrete or asphalt slab 4. As stud finder 8 is passed over the clip, the magnetic needle 9 is attracted to the clip apparatus by the emitted magnetic flux 7. Once the clips that are supporting the corners of heating mat 2 are located, the precise location of mat has been determined.

Figure 7:
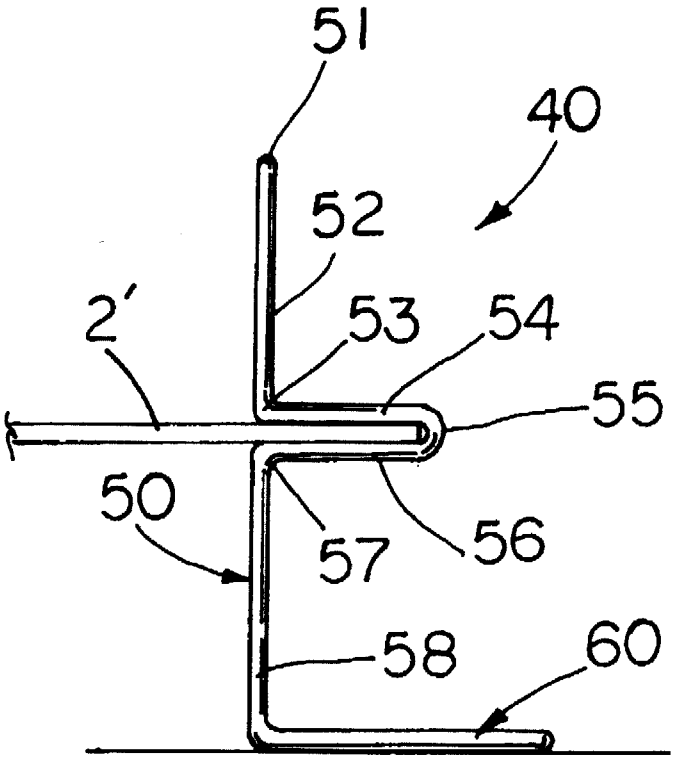
FIG. 7 is a perspective view of the apparatus of FIG. 6 and a conventional electrical heating mat.
Figure 6:
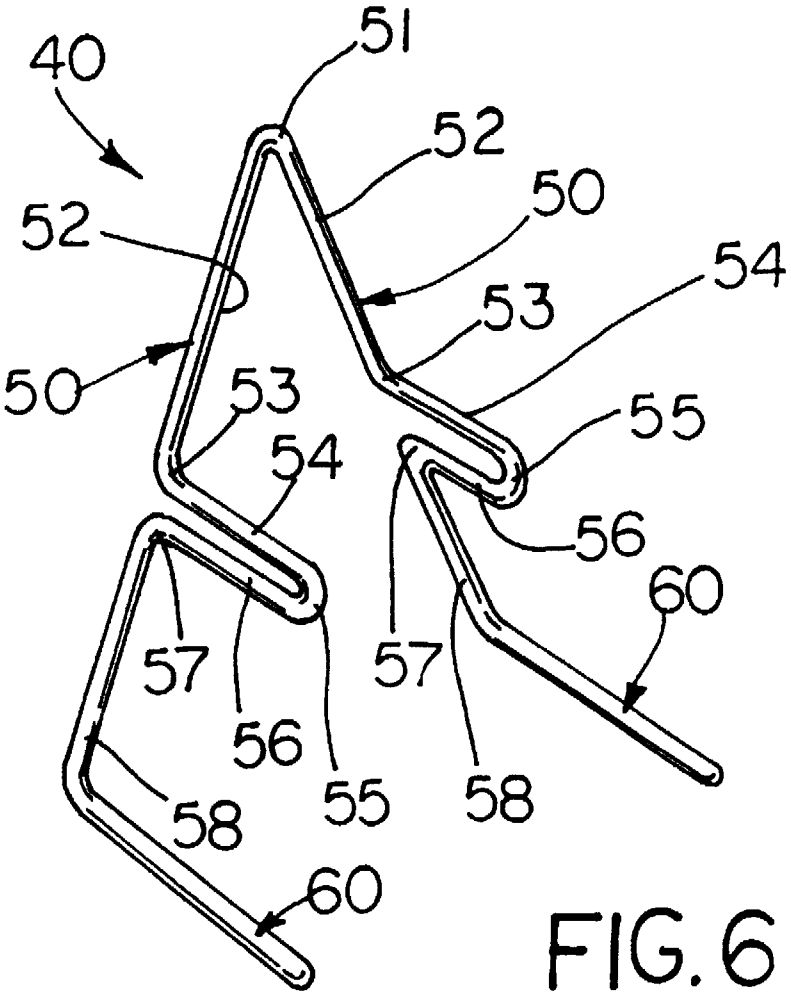
FIG. 6 is a perspective of a second embodiment of the clip of this invention.

FIGS. 6 and 7 show a second embodiment of the clip 40 of this invention for use with a typical heating mat 2'. Clip 40 is also formed from a length of noncorrosive magnetic alloy wire, which is bent into the configuration shown. The configuration of clip 40 includes two symmetrical upright legs 50 and two horizontal feet 60. Legs 50 diverge from an apex 51. Legs 50 lie in a substantially upright plane. As shown, each leg 50 has a right angle bend 53, an 180° return bend 55 and second right angle bend 57, which forms two overlying horizontal parallel segments 54, 56 located intermediately between two upright segments 52, 58. Overlying horizontal segments 54, 56 extend normally to the upright plane of legs 50. Feet 60 extend horizontally normal to the upright plane of legs 50 and allow the apparatus to stand erect.

As show in FIG. 7, the flat edge of a heating mat 2' is interposed between parallel segments 54, 56. Parallel segments 54, 56 are located so that mat 2' is spaced within slab form 4 at a desired depth. One skilled in the art will note that legs 50 can be bent apart to make minor adjustments in the depth of heating mat 2'. Clips 40 are placed in each corner of mat 2, with multiple clips supporting the center of the mat as needed. Again, the length of legs 50 is sufficient to position apex 51 just below the surface of concrete slab 6, so that clip 10 is easily detected by stud finder 8. Positioning clip 40 at the corners of the heating mat, the magnetic field of each apparatus can be used to precisely locate the apparatus and thereby locate heating mat 2'.

Figure 8:
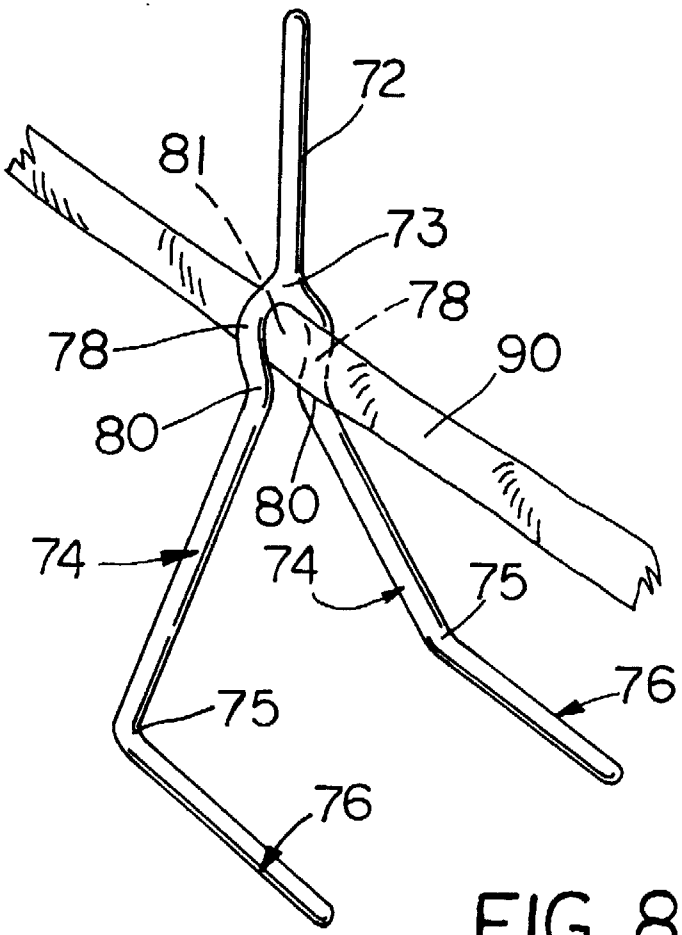
FIG. 8 is a perspective view of a third embodiment of the clip of this invention and a conventional electrical heating cable.

FIG. 8 shows a third embodiment of the clip 70 of this invention for use with buried cable 6. Unlike the prior two embodiments, clip 70 is cast in the configuration shown. Clip 70 has an elongated neck 72 and two symmetrical divergent leg segments 74, which diverge from a fork 73 at the lowermost end of neck 72. The legs 74 lie in a substantially upright plane. Each leg 74 has a lower bend 75 which forms a horizontal foot 76. Feet 76 extend horizontally normal to the upright plane of legs 74 and allow the apparatus to stand erect. The upper end of each leg 74 has a curved segment 78, which converges towards a knee 80. Curved segment 78 defines an opening 81 above knees 80 of each leg 74 for receiving cable 6. The resilient properties of the alloy material allow leg 74 to hold cable 6 within opening 81. Neck 72 extends a certain length so that its tip is positioned just below the surface of the soil, concrete or asphalt. In use, a plurality of clips are attached to elevate the heating cable to a desired uniform depth. A clip is attached at the ends of each heating cable, so that they are readily Locatable.

It is understood that the above description does not limit the invention to the details given, but may be modified within the scope of the following claims.

I claim:

1. A clip apparatus for use in supporting and affixing a buried cable at a desired depth while being buried or embedded within earth, asphalt or concrete, the improvement comprising said clip apparatus having magnetic properties for allowing said clip apparatus once buried with said buried cable to be located by a magnetic field, said clip apparatus includes an elongated upright neck part, two upright leg segments diverging from the lower end of said neck part, a horizontal foot segment integrally extending from the lower end of each said leg segment, and means for supporting said buried cable between said leg segments at a height above said horizontal foot segments wherein each said leg segment has a curved segment adjacent said neck part defining an opening for restrictively receiving said buried cable therein.

* * * * *